US005709525A

United States Patent [19]

Marzullo et al.

[11] Patent Number: 5,709,525

[45] Date of Patent: Jan. 20, 1998

[54] ENVELOPE STACKER

[75] Inventors: Joseph H. Marzullo, Brookfield; David E. Kayser, Middlebury; Irena Makarchuk, Fairfield; David W. Hubbard, Stamford; Walter Wolog, Orange, all of Conn.

[73] Assignee: Pitney Bowes Inc., Stamford, Conn.

[21] Appl. No.: 510,209

[22] Filed: Aug. 2, 1995

[51] Int. Cl.[6] ..... B65H 29/22

[52] U.S. Cl. ..... 414/798.7; 271/181; 271/287; 271/290

[58] Field of Search ..... 271/180, 181, 271/273, 287, 290; 414/798.6, 798.7, 786

[56] References Cited

U.S. PATENT DOCUMENTS

| | | | |
|---|---|---|---|
| 3,458,383 | 7/1969 | Kirk et al. | 156/566 |
| 3,716,227 | 2/1973 | Bottcher | 271/180 |
| 4,314,644 | 2/1982 | Stocker | 209/569 |
| 4,678,072 | 7/1987 | Kobayashi et al. | 271/181 X |
| 5,104,681 | 4/1992 | Sansone | 427/8 |
| 5,551,834 | 9/1996 | Thompson et al. | 414/798.7 |

*Primary Examiner*—Janice L. Krizek

*Attorney, Agent, or Firm*—Brigitte L. Jeffery; Angelo N. Chaclas; Melvin J. Scolnick

[57] ABSTRACT

In an envelope stacker, a pusher mechanism continuously applies a force to the envelope flap for sealing the envelope. The stacker is comprised of a horizontal deck, a rear wall, and a plate for supporting a stack of envelopes. Upon receiving an envelope, a pusher advances the envelope towards the stack of envelopes while applying a continuous force to the flap and rear panel of the envelope.

6 Claims, 6 Drawing Sheets

ENVELOPE STACKER

This invention relates to an envelope stacker designed for use in connection with an envelope offset apparatus such as one of the general type shown in the co-pending application of Joseph H. Marzullo and David Kayser, Ser. No. 08/510,351, filed Aug. 2, 1995, now U.S. Pat. No. 5,651,543.

BACKGROUND OF THE INVENTION

In mail handling machines, moistening devices are used to wet the flap of an envelope in preparation for sealing the envelope. The water causes the glue on the envelope flap to soften and become tacky to the touch. Conventionally, the envelope is fed between two sealing rollers which press the flap against the envelope body to form the seal. Then, the envelope is passed on to a stacker device. A disadvantage found in the prior art mailing machines is that envelopes may enter the stacker device unsealed, primarily in high speed mailing machines where the sealing rollers may contact the envelope for a limited period of time. By extending the amount of time the sealing rollers contact the envelope, the mailing machine would effectively reduce the overall processing rate of mail pieces.

Thus, it is an object of the subject invention to provide an envelope stacker wherein a pusher mechanism continuously applies a force to the envelope flap for sealing the envelope.

SUMMARY OF THE INVENTION

The above object is achieved and the disadvantages of the prior art are overcome by means of the subject invention which comprises a horizontal deck for supporting a stack of envelopes. The stack of envelopes have a forwardmost envelope and a rearmost envelope. Each envelope of the stack of envelopes has a bottom edge engaging the deck, a flap, a front panel, and a rear panel. A rear wall is fixably attached at a first end of the deck and extends generally perpendicular to the deck. A plate is in parallel alignment with the rear wall. The plate is spring mounted to the rear wall and has a face engaging the front panel of the forwardmost envelope. Pushing means advance a received envelope from a second end of the deck towards the stack of envelopes. Further, the pushing means apply a continuous force to the flap and the rear panel of the received envelope.

BRIEF DESCRIPTION OF THE DRAWINGS

These and other objects and advantages of the present invention will become apparent from the following description of the accompanying drawings. It is to be understood that the drawings are to be used for the purpose of illustration only, and not as a definition of the invention.

In the drawings.

DESCRIPTION OF THE PREFERRED EMBODIMENT

Figure 1:
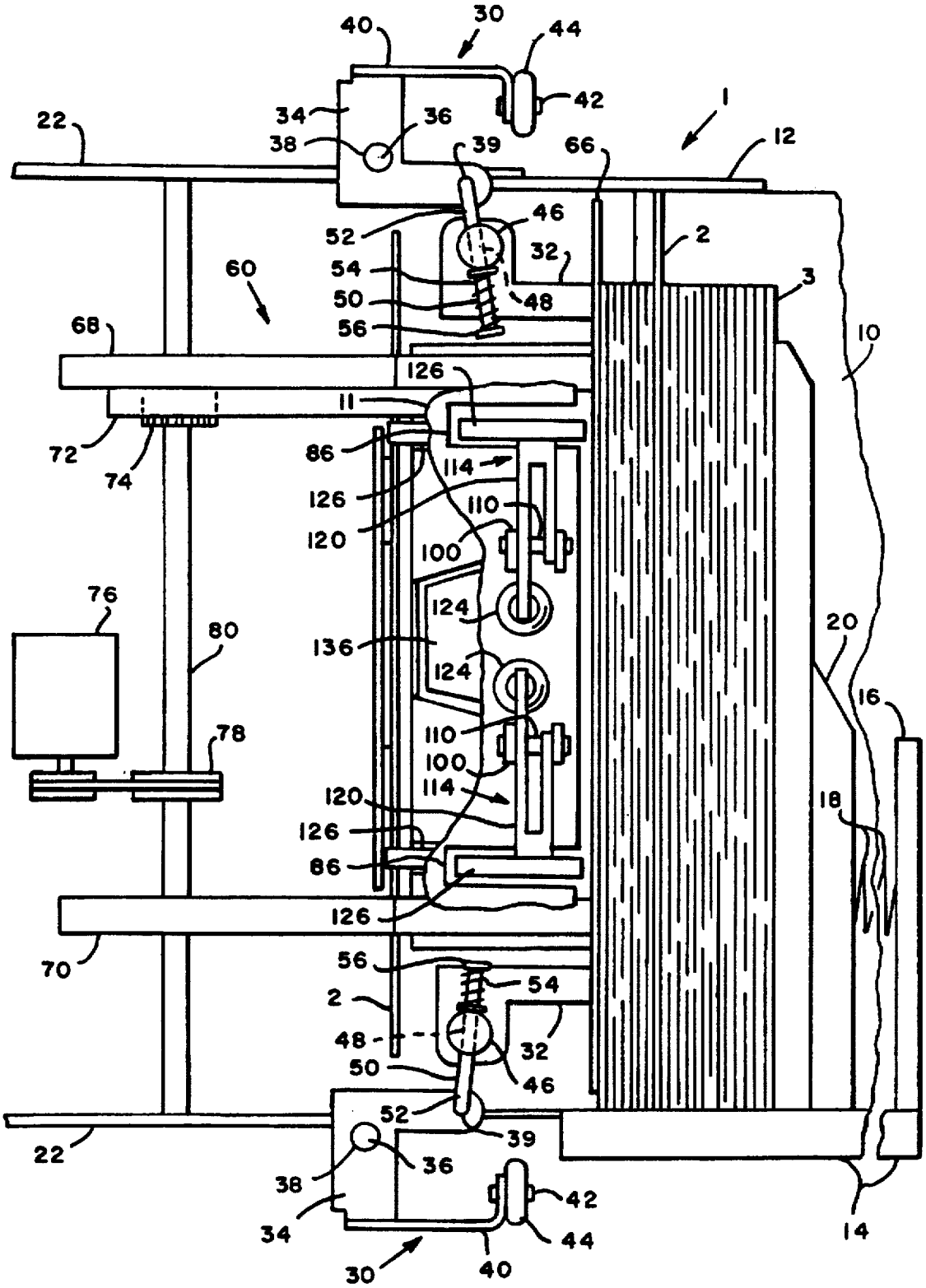
FIG. 1 represents a fragmented, top view of the envelope stacker.
Figure 2:
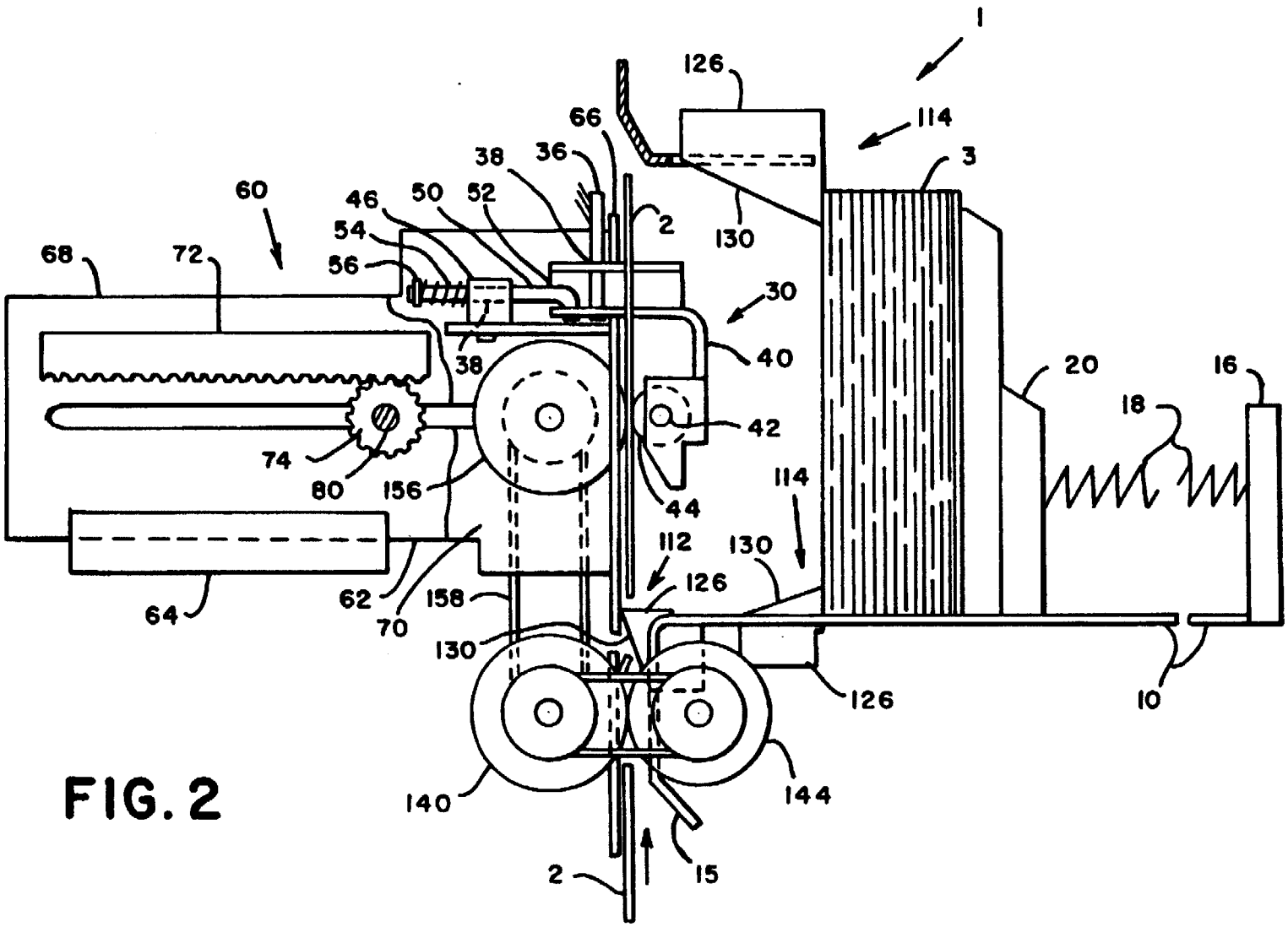
FIG. 2 represents a fragmented, side view of the FIG. 1 stacker.
Figure 5:
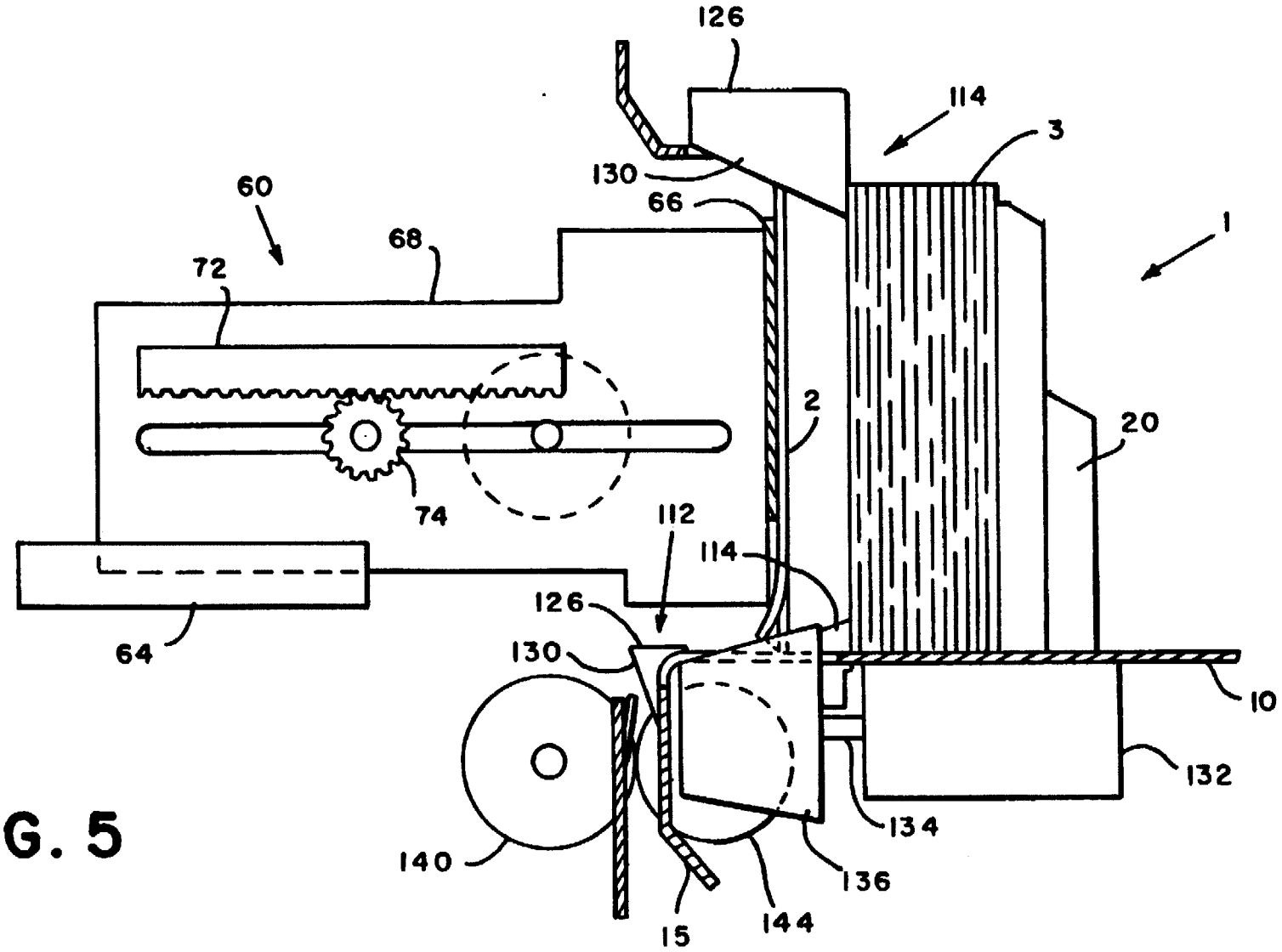
FIG. 5 represents a side view of the stacker receiving a mail piece.

FIG. 1 illustrates a preferred embodiment showing a top view of an envelope stacker 1 having a lower deck 10 which has fixably mounted thereto, in vertical alignment, transversely spaced apart side walls 12 and 14. FIG. 5 illustrates the envelope stacker 1 of the preferred embodiment in a side view. Referring to FIGS. 1 and 5, concurrently, the side walls 12 and 14 serve principally as a lateral registration abutment for each envelope 2 in the envelope stack 3. Referring to FIGS. 1 and 2, lower deck 10 has a guiding edge 15 for guiding an envelope 2 into the stacker 1. The lower deck 10 is fixably attached to a rear wall 16. A spring 18, having one end fixedly attached to the rear wall 16, and the other end thereof fixedly attached to a plate 20, supplies a biasing force which causes the plate 20 to remain in contact with a forwardmost envelope in the envelope stack 3. The plate 20 serves principally as a longitudinal registration abutment for the envelope stack 3 and secondarily as an obstructing mechanism which halts the forward movement of the envelope stack 3.

Still referring to FIGS. 1 and 5, pivotally mounted to a frame 22 of the envelope stacker 1 is a normal force roller assembly 30 which comprises a plate 32 and a bracket 34 having a pivot pin 36 and an aperture 38. The bracket 34 further has an arm 40 with a shaft 42 extending therefrom. An idler roller 44 is mounted to shaft 42.

A hub 46 rotatably mounted to plate 32 has a slot 48 through which extends a generally L-shaped pin 50. A first end portion 52 of the L-shaped pin 50 engages aperture 39 of bracket 34. A spring 54 is coiled around the L-shaped pin 50 between a second end portion 56 of the pin 50 and the hub 46.

Referring now to FIGS. 1 and 2 concurrently, a vertically aligned pusher 60 is fixably attached to plate 32. Pusher 60 is comprised of a base 62 supported by guides 64, a forward wall 66, and side walls 68 and 70 in transversely spaced apart parallel alignment. Side wall 68 has mounted thereon a rack gear 72. Pinion gear 74 is operatively connected to the rack gear 72. A motor 76 is in drive communication with idler gear 78 which shares a common shaft 80 with pinion gear 74 whereby rotation of the motor 76 thereby rotates the pinion gear 74.

Figure 3:
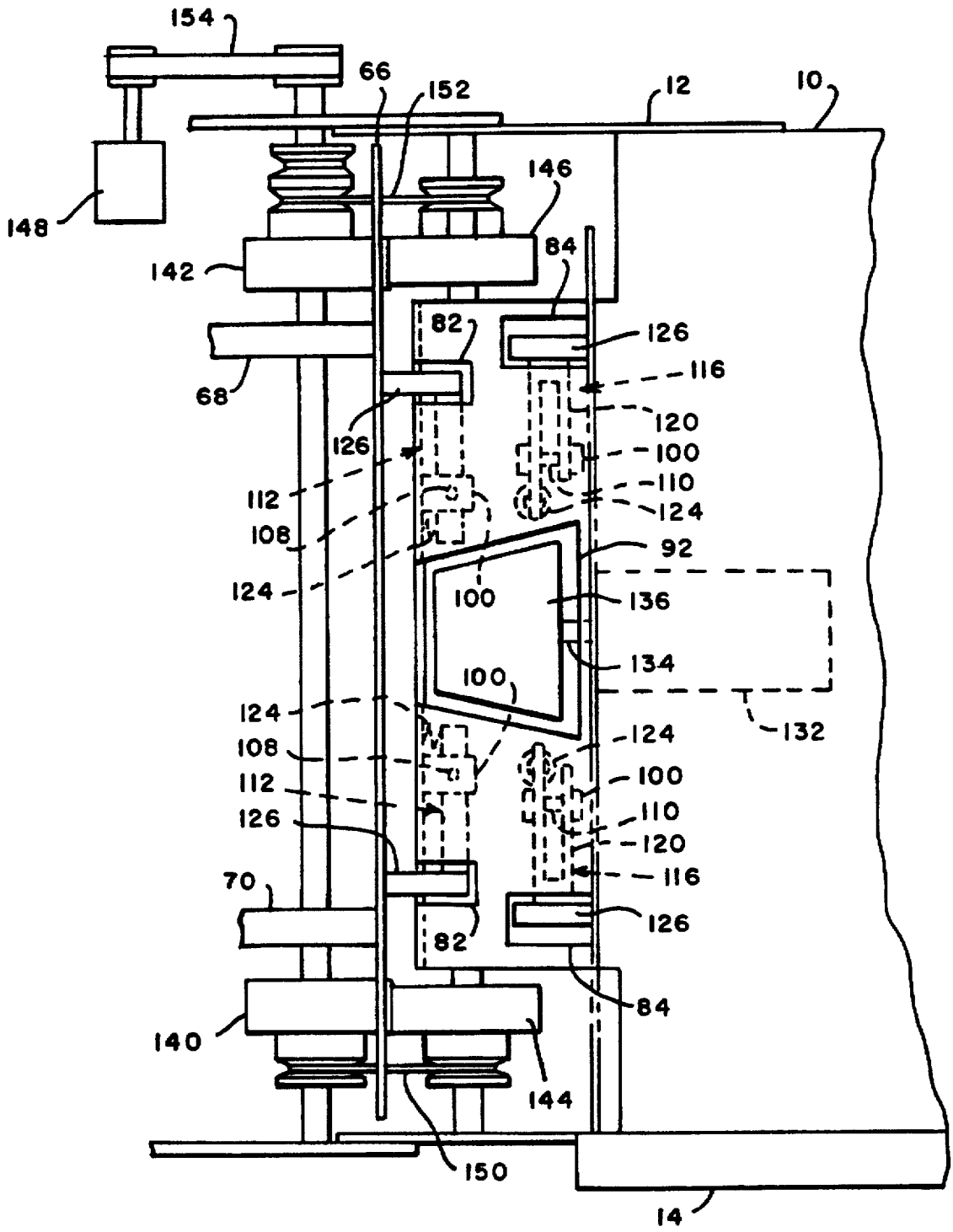
FIG. 3 represents a fragmented, cross-sectional top view of the stacker.

Referring to FIGS. 1 and 3, the lower deck 10 and an upper deck 11 contain a plurality of slots 82, 84, 86, and 92. Fixably mounted to the underside of the lower deck 10 and upper deck 11 are a plurality of substantially U-shaped mounting blocks 100. Each mounting block 100 has a plurality of apertures 108 for receiving a pivot pin 110. Input gates 112 are connected to blocks 100 mounted to the underside of the lower deck 10. Output gates 114, 116 are connected to blocks 100 mounted to the underside of upper deck 11 and lower deck 10 respectively. The gates 112, 114, and 116 include a yoke-shaped end portion 120 pivotally connected to the mounting block 100 by means of pin 110 such that the end portion 120 is oriented parallel to the decks 10, 11. In order to retain the gates 112, 114, and 116 in a home position, a spring 124 is secured to the deck 10 or 11. The spring 124 has a free end which engages the end portion 120 of gates 112, 114, and 116 thereby biasing the gates 112, 114, and 116 toward the home position.

Referring to FIGS. 2 and 3, each gate 112, 114, and 116 further has a front portion 126 having an angled surface 130. The front portion 126 of each gate 112, 114, and 116 extends generally perpendicular to the end portion 120 so that in the home position, the angled surface 130 extends through the slots 82, 84, 86 in the deck 10, 11.

Still referring to FIG. 3, mounted to the underside of the lower deck 10 is a motor 132 having a shaft 134. A generally conical shaped elastomer roller 136 is mounted onto the shaft 134 of the motor 132. The roller 136 extends above the lower deck 10 through slot 92 in deck 10. Roller 136 will rotate in a clockwise or counterclockwise direction depending upon the direction of rotation of motor shaft 134.

Referring now to FIGS. 2 and 3 concurrently, driving means for driving an envelope 2 into the envelope stacker 1 comprises feed rollers 140, 142, 144, 146 rotated by a motor 148 coupled thereto by suitable means such as a pulley drive 150, 152, and 154 entrained about rollers 140, 142, 144, 146. Roller 156 is in drive communication with roller 140 by means of pulley 158.

Figure 6:
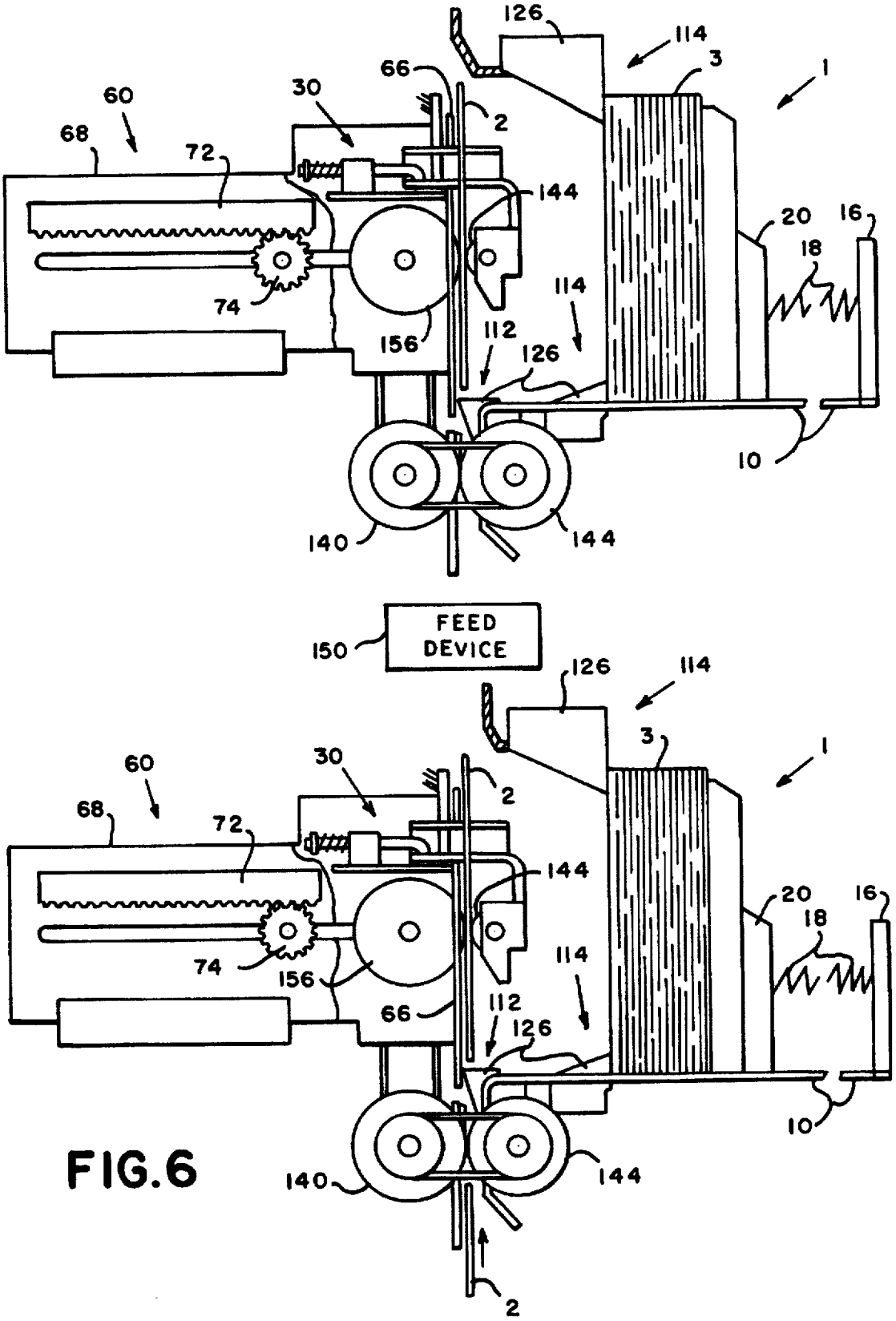
FIG. 6 represents an alternate embodiment of the invention with a plurality of stackers.

FIG. 6 represents an alternate embodiment of the invention with a plurality of envelope stackers 1. In this embodiment, the plurality of stackers 1 are positioned in vertical alignment. A conventional feed device 150 is positioned between the plurality of stackers 1. The feed device comprises a pair of parallel, vertically aligned endless belts which extend around a pair of transport rollers. The transport rollers are under the drive influence of feed roller 140 and coupled thereto by suitable means such as a pulley drive.

PRACTICAL OPERATION

In the operation of the subject invention, it is desirable to provide an envelope stacker 1 wherein a pusher mechanism 60 continuously applies a force to the envelope flap for sealing the envelope 2.

Turning now to FIG. 1, the operation of a specific embodiment of the present invention is illustrated. In the home position depicted in FIG. 1, the pinion gear 74 is in rearmost engagement with the rack gear 72. Accordingly, the pusher 60 is at a forwardmost position so that the forward wall 66 maintains contact with the last fed envelope of the stack of envelopes 3. In the forwardmost position, the pusher 60 applies a forces to the last fed envelope to further assist adhesion of the envelope flap to the envelope body. In the home position, the idler roller 44 remains disengaged from feed roller 156.

When the stacker 1 receives a signal that an envelope is being transported to the stacker 1, the motor 76 begins to rotate thereby moving the pinion gear 74 forward within rack 72. This results in the pusher 60 traveling in a rearward direction thereby causing the L-shaped pin 50 engaged with bracket 34 to pivot the idler roller 44 into contact with feed roller 156. The output gates 114 in conjunction with the spring biased plate 20 hold the stack of envelopes 2 in an upright, vertical position to prevent the envelopes from falling back and into the path of an incoming envelope in the absence of pusher 60 (see FIG. 2).

Figure 4:
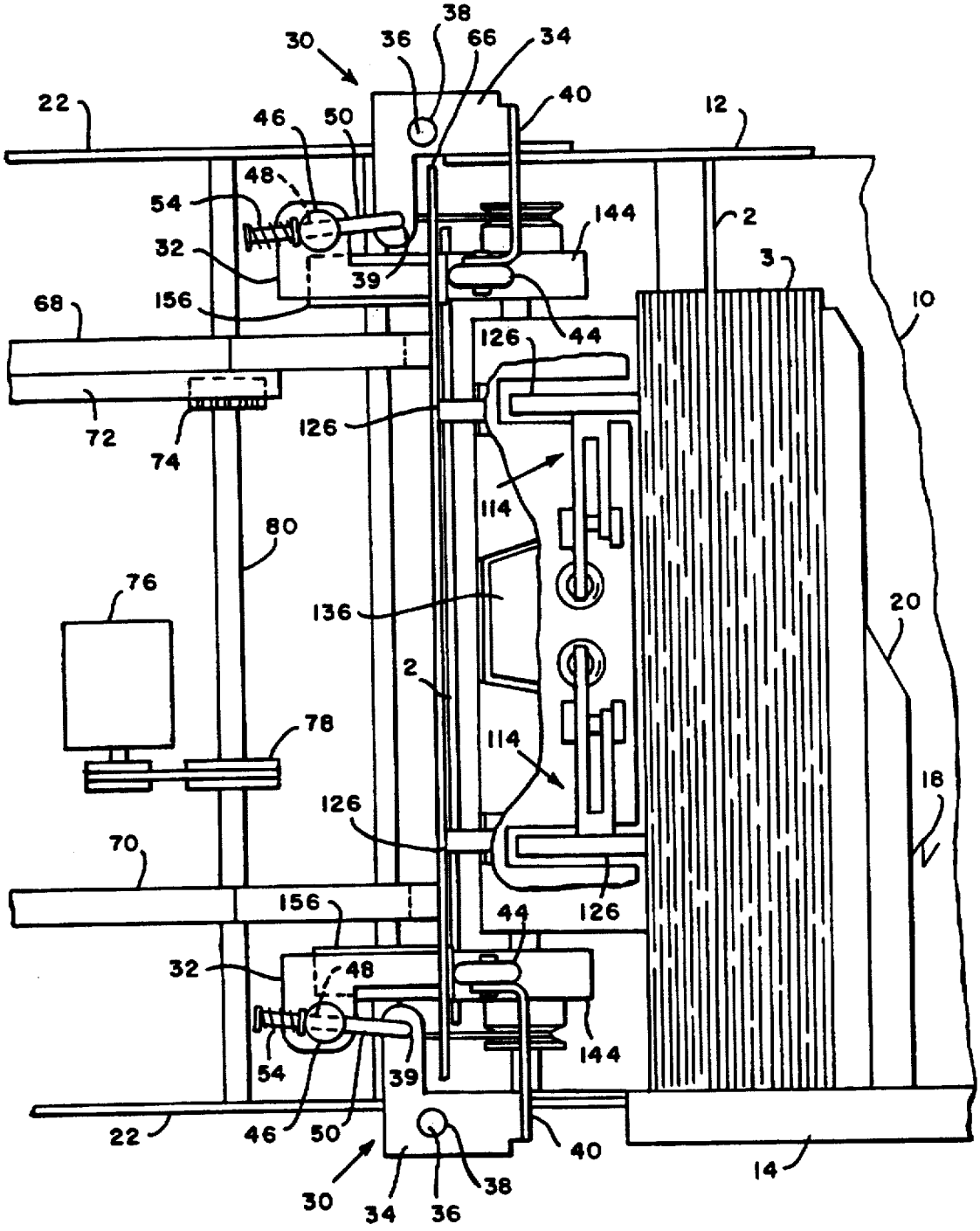
FIG. 4 represents a fragmented, top view of the stacker receiving a mail piece.

Referring to FIGS. 2 and 4, upon receiving an appropriate signal, the driving means drive an incoming envelope 2 into the stacker 1. A vertically fed envelope 2 is guided between the nip of rollers 140 and 144 by the guiding edge 15 of the lower deck 10. The envelope 2 is transported vertically thereby engaging the angled surface 130 of the input gates 112. The driving force of the envelope 2 against the input gates 112 will cause the gates 112 to pivot in a direction perpendicular to the vertical path of travel of the envelope 2 thereby permitting the envelope 2 to engage the nip formed by feed roller 156 and idler roller 44. After the bottom edge of the envelope 2 clears the input gates 112, the spring biased gates 112 will return to the home position and the driving means will cease driving the envelope 2.

Referring to FIG. 5, the pinion gear 74 will rotate so as to move the pusher 60 forward thereby causing the L-shaped pin 50 engaged with bracket 34 to pivot the idler roller 44 out of contact with feed roller 156. Pivoting the idler roller 44 will cause the envelope 2 to drop vertically onto the top of the input gates 112. The motor 76 will momentarily discontinue forward motion of the pinion gear 74 as the envelope 2 settles on the input gates 112.

Still referring to FIG. 5, after pausing for a predetermined time, the motor 76 will resume driving the pinion gear 74 so that the pusher 60 moves forward, displacing the vertically oriented envelope 2 in a substantially horizontal direction. As the pusher 60 moves forward, the forward wall 66 drives the envelope 2 into contact with the surface of the elastomer roller 136. The forward motion of the pusher 60 causes the envelope 2 to bend thereby providing additional normal force for driving the envelope 2 forward, across the elastomer roller 136. As the envelope 2 is driven forward, the roller 136 begins to rotate in a predetermined direction. The rotation of the elastomer roller 136 in a predetermined direction will drive the envelope 2 laterally against a side registration edge 12 or 14 to either offset the envelope 2 or register and align the envelope 2 with a common group of envelopes. The pusher 60 continues to drive the envelope 2 forward and into contact with the angled surface 130 of the output gates 114. As the pusher 60 moves forward, the top edge and bottom edge of the envelope 2 causes the output gates 114 to rotate in a direction perpendicular to the horizontal path of travel of the envelope 2.

Referring to FIG. 6, in the alternate embodiment of the invention which includes a plurality of stackers 1, the rear wall 16 of the bottom stacker 1 reaches a predetermined position which indicates a full stacker. After the bottom edge of the envelope 2 clears the input gates 112, the spring biased gates 112 will return to the home position and the envelope 2 will be driven through the feed device 150 and into the top stacker 1.

The foregoing description of the preferred and alternate embodiments of the present invention have been presented for purposes of illustration and description. It is not intended to be exhaustive or to limit the invention to the precise form disclosed. Obviously, many modifications and variations will be apparent to practitioners skilled in this art. The embodiment was chosen and described in order to best explain the principles of the invention and its practical application thereby enabling others skilled in the art to understand the invention for various embodiments and with various modifications as are suited to the particular use contemplated. It is intended that the scope of the invention be defined by the accompanying claims and their equivalents.

What is claimed is:

1. An envelope stacker for a vertically oriented stack of envelopes, comprising:

a horizontal deck for supporting the stack of envelopes, the stack of envelopes having a forwardmost envelope and a rearmost envelope, each envelope of the stack of envelopes having a bottom edge engaging the deck, a flap, a front panel, and a rear panel;

a rear wall fixably attached at a first end of the deck and extending generally perpendicular to the deck;

a plate in parallel alignment with the rear wall, the plate being spring mounted to the rear wall, the plate further having a face engaging the front panel of the forwardmost envelope;

means for receiving an incoming envelope; and pushing means for pushing the incoming envelope from a second end of the deck towards the stack of envelopes, the pushing means further applying a continuous force to the flap and the rear panel of the incoming envelope;

and wherein the pushing means comprises a pusher, a rack gear fixably mounted to the pusher, a pinion gear oOperatively connected to the rack gear, and driving means for rotating the pinion gear in a first direction whereby the pinion gear travels rearwardly along the rack gear thereby displacing the pusher horizontally towards the first end of the deck, the driving means further rotating the pinion gear in a second direction whereby the pinion gear travels forwardly along the rack gear thereby displacing the pusher horizontally towards the second end of the deck.

2. An envelope stacker according to claim 1 further comprising retaining means for retaining the stack of envelopes in a substantially vertical position as the pinion gear displaces the pusher horizontally towards the second end of the deck.

3. A plurality of envelope stackers in vertical alignment, each stacker comprising:

a horizontal deck for supporting a stack of vertically oriented envelopes, the stack of envelopes having a forwardmost envelope and a rearmost envelope, each envelope of the stack of envelopes having a bottom edge engaging the deck, a flap, a front panel, and a rear panel;

a rear wall fixably attached at a first end of the deck and extending generally perpendicular to the deck;

a plate in parallel alignment with the rear wall, the plate being spring mounted to the rear wall, the plate further having a face engaging the front panel of the forwardmost envelope;

means for receiving an incoming envelope;

pushing means for pushing the incoming envelope from a second end of the deck towards the stack of envelopes, the pushing means further applying a continuous force to the flap and the rear panel of the incoming envelope; and, means for advancing the incoming envelope to a subsequent stacker.

4. The plurality of envelope stackers according to claim 3 wherein the pushing means of each stacker comprises a pusher, a rack gear fixably mounted to the pusher, a pinion gear operatively connected to the rack gear, and driving means for rotating the pinion gear in a first direction whereby the pinion gear travels rearwardly along the rack gear thereby displacing the pusher horizontally towards the first end of the deck, the driving means further rotating the pinion gear in a second direction whereby the pinion gear travels forwardly along the rack gear thereby displacing the pusher horizontally towards the second end of the deck.

5. The plurality of envelope stackers according to claim 4, each stacker further comprising retaining means for retaining the stack of envelopes in a substantially vertical position as the pinion gear displaces the pusher horizontally towards the second end of the deck.

6. The plurality of envelope stackers according to claim 5, each stacker further comprising detecting means for detecting a full stacker.

* * * * *